US007457741B2

(12) United States Patent
Nakagawa et al.

(10) Patent No.: US 7,457,741 B2
(45) Date of Patent: Nov. 25, 2008

(54) DEVICE FOR TRANSMITTING SPEECH INFORMATION

(75) Inventors: Seiji Nakagawa, Ikeda (JP); Kiyoshi Fujimoto, Ikeda (JP); Yoh-ichi Fujisaka, Ikeda (JP); Yosuke Okamoto, Ikeda (JP)

(73) Assignee: National Institute of Advnaced Industrial Science and Technology, Tokyo (JP)

( * ) Notice: Subject to any disclaimer, the term of this patent is extended or adjusted under 35 U.S.C. 154(b) by 665 days.

(21) Appl. No.: 11/091,480

(22) Filed: Mar. 29, 2005

(65) Prior Publication Data

US 2005/0222845 A1 Oct. 6, 2005

(30) Foreign Application Priority Data

Mar. 30, 2004 (JP) ..... 2004-099395
Mar. 31, 2004 (JP) ..... 2004-103586

(51) Int. Cl.
*G10L 21/00* (2006.01)
*H04R 25/00* (2006.01)

(52) U.S. Cl. ..... 704/200; 704/225; 381/23.1; 381/312

(58) Field of Classification Search ..... 704/200, 704/225; 381/23.1, 312
See application file for complete search history.

(56) References Cited

U.S. PATENT DOCUMENTS 5,012,520 A * 4/1991 Steeger ..... 381/315
5,571,148 A * 11/1996 Loeb et al. ..... 607/57
5,921,928 A * 7/1999 Greenleaf et al. ..... 600/437
6,636,768 B1 * 10/2003 Harrison ..... 607/57

FOREIGN PATENT DOCUMENTS

JP 10285697 A * 10/1998
JP 2001-320799 11/2001

* cited by examiner

*Primary Examiner*—Daniel D Abebe
(74) *Attorney, Agent, or Firm*—Kratz, Quintos & Hanson, LLP

(57) ABSTRACT

A device (1) for transmitting speech information to the human body, comprising:

a microphone (2) for inputting speech from an external source;

a speech signal processor (20) that produces a consonant-clarified signal based on the input speech signal;

a carrier signal generator (6) that produces a carrier signal;

an amplitude modulator (8) that modulates the amplitude of the carrier signal based on the consonant-clarified signal; and a vibrator (12) that transmits mechanical vibrations based on the amplitude-modulated output signal;

the speech signal processor (20) comprising:

a consonant extracting unit that extracts the consonant parts from the speech signal; and a repetition processing unit that adds the extracted consonant parts to the speech signal to produce a consonant-clarified signal in which each of the consonant parts of the speech signal is repeated two or more times. This speech information transmitting device realizes good discriminability of speech information.

10 Claims, 10 Drawing Sheets

Carrier signal

Speech signal

DSB modulated signal
Voltage
Time

DEVICE FOR TRANSMITTING SPEECH INFORMATION

TECHNICAL FIELD

The present invention relates to a device for transmitting speech information to the human body.

BACKGROUND ART

Hearing aids for people with hearing difficulties have been known as speech information transmitting devices. Hearing aids can be divided into air conduction hearing aids that transmit sound vibrations to the cerebral auditory areas via the eardrum, and bone conduction hearing aids that transmit sound vibrations directly to the human body, for example to the skull, not via the eardrum. Such hearing aids are used by attaching an earphone or vibrator to a part of the human body. Recently, structures have become known which enable the transmission of speech information by transferring supersonic vibrations to the cerebral auditory areas through a vibrator. For example, Japanese Unexamined Patent Publication No. 2001-320799 discloses a structure in which a sound signal is subjected to DSB (double sideband) amplitude modulation and transmitted to the human body through an ultrasound transducer.

However, hitherto known speech information transmitting devices still have room for improvement with respect to increasing the discriminability of speech.

DISCLOSURE OF THE INVENTION

An object of the present invention is to provide a device for transmitting speech information with high discriminability.

This object of the present invention can be accomplished by a device for transmitting speech information to the human body, the device comprising:

a microphone for inputting speech from an external source;

a speech signal processor that produces a consonant-clarified signal based on the input speech signal;

a carrier signal generator that produces a carrier signal;

an amplitude modulator that modulates the amplitude of the carrier signal by the consonant-clarified signal; and a vibrator that transmits mechanical vibrations based on the amplitude-modulated output signal;

the speech signal processor comprising:

a consonant extracting unit that extracts consonant parts from the speech signal; and a repetition processing unit that adds the extracted consonant parts to the speech signal to produce the consonant-clarified signal in which each of the consonant parts of the speech signal is repeated two or more times.

The above object of the present invention can also be accomplished by a device for transmitting speech information to the human body, the device comprising:

a microphone for inputting speech from an external source;

a speech amplifier that amplifies the input speech signal;

a carrier signal generator that produces a carrier signal;

a suppressed carrier modulator that performs suppressed carrier modulation of the speech signal by the carrier signal, to produce a suppressed carrier signal from which carrier components have been removed;

an output amplifier that amplifies the suppressed carrier signal; and a vibrator that transmits mechanical vibrations based on the amplified suppressed carrier signal.

The above object of the present invention can also be achieved by a device for transmitting speech information to the human body, the device comprising:

a microphone for inputting speech from an external source;

a speech signal processor that produces a consonant-clarified signal based on the input speech signal;

a carrier signal generator that produces a carrier signal;

a suppressed carrier modulator that performs suppressed carrier modulation of the consonant-clarified signal by the carrier signal, to produce a suppressed carrier signal from which carrier components have been removed;

an output amplifier that amplifies the suppressed carrier signal; and a vibrator that transmits mechanical vibrations based on the amplified suppressed carrier signal;

the speech signal processor comprising:

a consonant extracting unit that extracts consonant parts from the speech signal; and a repetition processing unit that adds the extracted consonant parts to the speech signal to produce the consonant-clarified signal in which each of the consonant parts of the speech signal is repeated two or more times.

BEST MODE FOR CARRYING OUT THE INVENTION

Embodiments of the present invention are described below, with reference to the accompanying drawings.

(First Embodiment)

Figure 1:
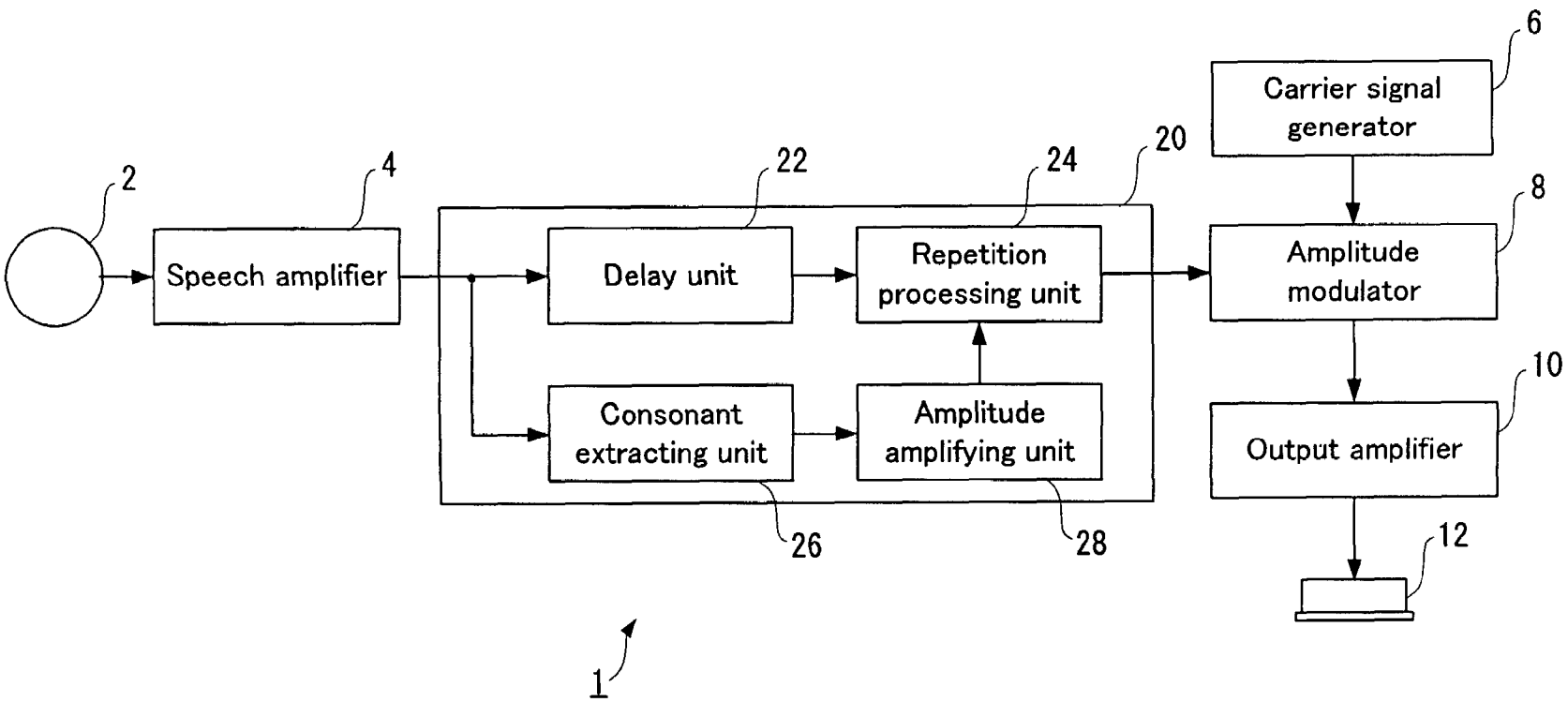
FIG. 1 is a block diagram showing the configuration of a speech information transmitting device according to a first embodiment of the present invention.
Figure 2:
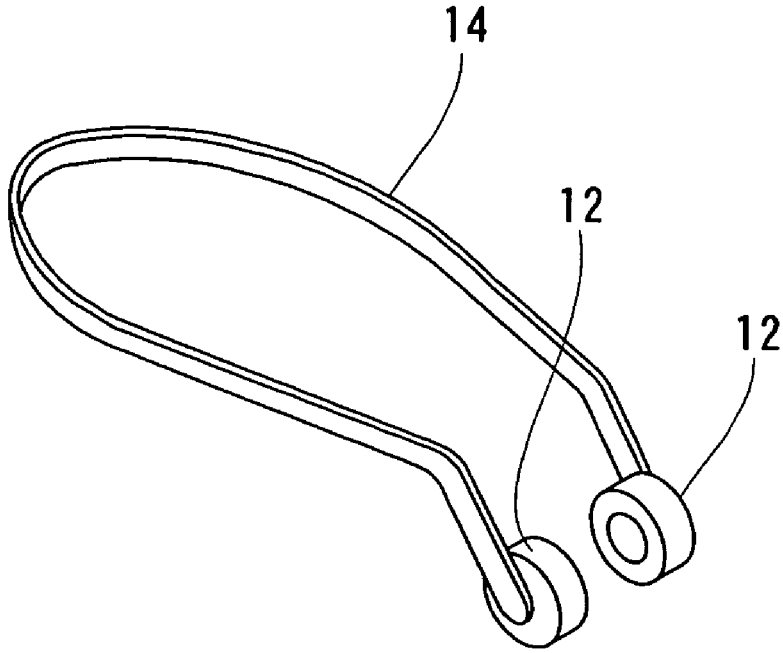
FIG. 2 is a perspective view showing an example of the attached state of the vibrator in the speech information transmitting device of FIG. 1.

FIG. 1 is a block diagram showing the configuration of a speech information transmitting device according to a first embodiment of the present invention. As shown in FIG. 1, this speech information transmitting device 1 comprises:

a microphone 2 for inputting speech from an external source;

a speech amplifier 4 that amplifies the input speech signal;

a speech signal processor 20 that produces a consonant-clarified signal based on the speech signal;

a carrier signal generator 6 that produces a carrier signal;

an amplitude modulator 8 that modulates the amplitude of the carrier signal by the consonant-clarified signal;

an output amplifier 10 that amplifies an output signal from the amplitude modulator 8; and a vibrator 12 that transmits mechanical vibrations based on the amplified output signal.

The speech signal processor 20 comprises a delay unit 22 that delays the input speech signal for a predetermined period of time (for example, several tens to several hundreds of milliseconds). The delayed speech signal is input to the repetition processing unit 24.

The speech signal that is input to the speech signal processor 20 is also input to the consonant extracting unit 26, in which consonant parts are extracted from the speech signal. The method for extracting consonant parts is not limited. For example, the number of zero crossings of the speech signal within a unit time can be detected, and regions in which zero crossings occur more than a predetermined number of times can be judged as consonant parts. In this embodiment, consonant parts are extracted by detecting regions in which the amplitude of the speech signal is equal to or smaller than a predetermined value, as described hereinafter. The amplitude of the consonant parts extracted by the consonant extracting unit 26 is amplified in an amplitude amplifying unit 28, and then input to the repetition processing unit 24.

The repetition processing unit 24 adds the extracted consonant parts to the speech signal from the delay unit 22 to produce a consonant-clarified signal in which each of the consonant parts of the speech signal is repeated two or more times.

The carrier signal generator 6 produces a desired carrier signal, and has a variable resistor or like means for enabling adjustment of the frequency of the carrier signal in the vicinity of the resonance frequency of the vibrator 12. The amplitude modulator 8 performs amplitude modulation of the input carrier signal by the consonant-clarified signal, and outputs the amplitude-modulated signal.

The vibrator 12 can be attached, for example, to each end of an elastically deformable, hair band-shaped fitting member 14, which can be worn over the head so that two vibrators 12, 12 can be held in contact with predetermined parts of the human body surface.

Next, the operation of the speech information transmitting device of this embodiment is described. When, with the switch of the device being turned on, speech is input to the microphone 2 from an external source, the speech signal is amplified to a predetermined level by the speech amplifier 4 and then output to the speech signal processor 20.

Figure 3:
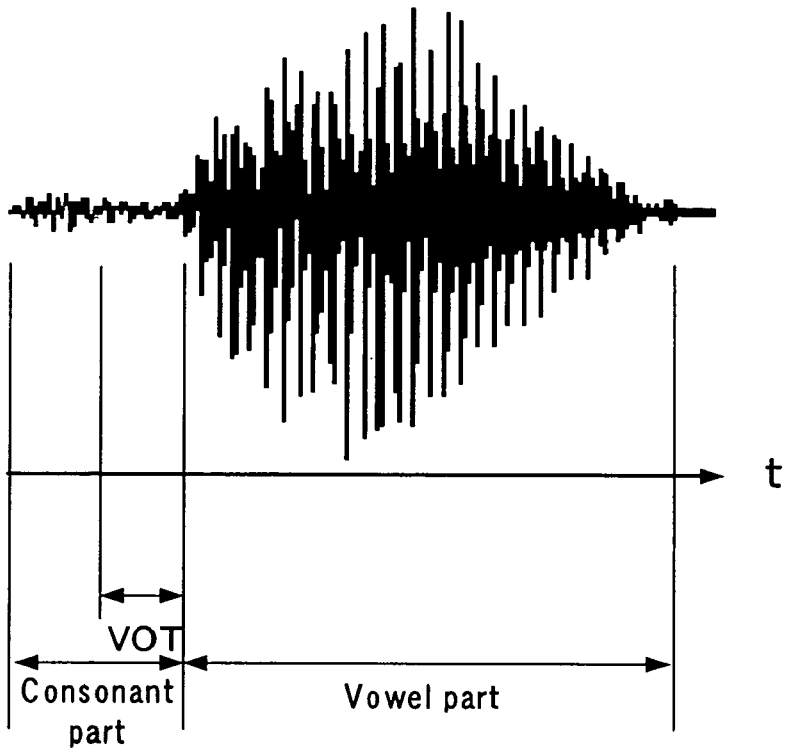
FIG. 3 shows an example of the waveform of a speech signal.

In the speech signal processor 20, consonant parts are extracted from the speech signal. As shown in FIG. 3, each of the consonant parts of the speech signal has about several tens of milliseconds of VOT (Voice Onset Time) before the beginning of the subsequent vowel part. VOT is a nearly silent interval from a consonant burst to the beginning of vocal cord vibrations. The amplitude is therefore smaller in VOT than in the start-up of the consonant part and in the vowel part. Thus, a suitable reference value is predetermined and a region in which the amplitude continues to be equal to or smaller than the reference value for a certain period of time (for example, about 10 ms) can be judged as VOT, to thereby distinguish VOT from the vowel part and the other portion of the consonant part and specify the end portion of the consonant part.

Further, vowel parts are usually followed by a silent interval of several tens of milliseconds or longer before the subsequent consonant part. This silent interval can be detected in the same manner as in the detection of VOT as mentioned above, to thereby specify the onset portion of the subsequent consonant part.

Since the amplitude is greater in vowel parts than in consonant parts, the question of whether a duration of an amplitude equal to or smaller than the reference value is VOT or a silent interval after a vowel can be judged depending on the magnitudes of the amplitudes before and after that duration. Accordingly, only the time waveform of a consonant part can be extracted by including VOT in the consonant part and excluding the silent interval after a vowel from the consonant part.

The consonant part extraction by the consonant extracting unit 26 can be achieved by extracting the entire consonant part as described above, or by extracting only VOT or only the portion other than VOT. In this embodiment, the portion other than VOT of a consonant part is extracted.

The consonant parts extracted in the consonant extracting unit 26 are input to the repetition processing unit 24 through the amplitude amplifying unit 28. The amplitude amplification in the amplitude amplifying unit 28 is not necessarily required, and the device can be constructed so that the consonant parts extracted in the consonant extracting unit 26 are directly input to the repetition processing unit 24, not through the amplitude amplifying unit 28. Too much amplification of the amplitude of the consonant parts makes the original speech unperceivable, and thus is not preferable. Therefore, in the amplitude amplifying unit 28, the amplitude ratio of the output signal relative to the input signal is preferably 1.0 to 5.0.

Figure 4:
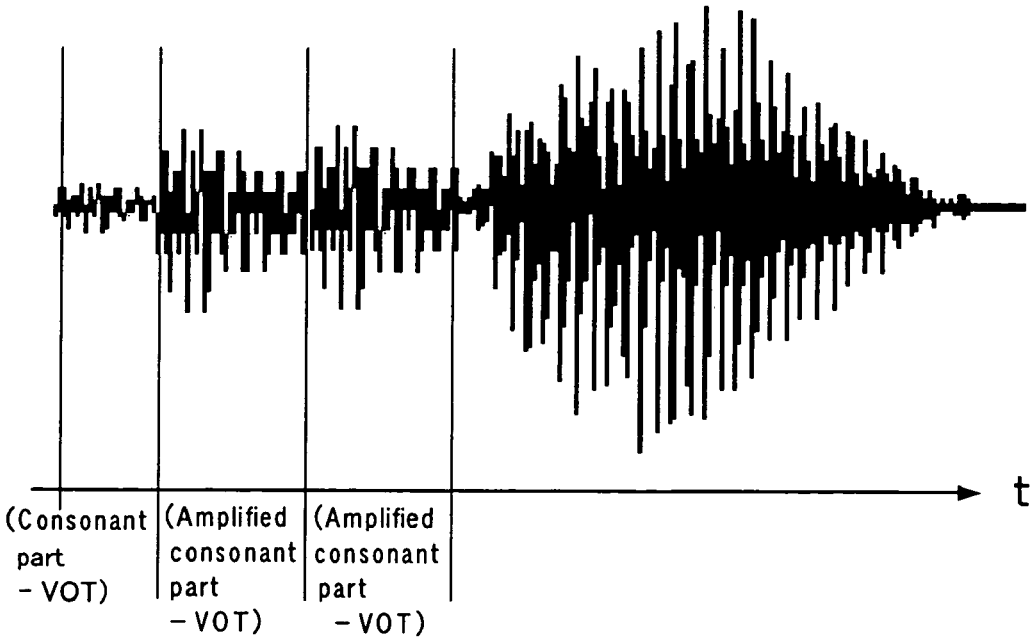
FIG. 4 shows an example of the waveform of a consonant-clarified signal.

The repetition processing unit 24 detects, in the speech signal that is input from the delay unit 22 in a delayed manner, a portion with the same waveform as the time waveform of the consonant part extracted by the consonant extracting unit 26. When a portion with the same waveform is detected, the amplified time waveform of the consonant part is inserted into the speech signal so as to repeat the consonant part two or more times. This converts the signal that is output from the repetition processing unit 24 into a consonant-clarified signal in which each of the consonant parts are emphasized by repeating them two or more times, as shown in FIG. 4.

The number of repetitions of each consonant part in the consonant-clarified signal is not limited as long as it is two or more times including the original consonant part contained in the speech signal, but consonant parts repeated too many times are likely to produce an unpleasant feeling in the user. Thus, the number of repetitions is preferably about 2 to 5.

The addition of a consonant part increases the time corresponding to a consonant by the amount of time occupied the added consonant part. The increment of time is preferably subtracted from the silent interval after the vowel to make the interval to the following consonant or vowel the same as that before the addition of the consonant part.

The carrier signal generator 6 produces a carrier signal consisting of sine waves. When the device is constructed so that the vibrator is to be in contact with the human body as in this embodiment, the frequency of the carrier signal is preferably 20 to 100 kHz and more preferably 20 to 50 kHz, in order to sufficiently transmit the vibrations to the cerebral auditory areas through the skin, muscles or bone of humans. The carrier signal is output to the amplitude modulator 8.

The amplitude modulator 8 performs amplitude modulation of the carrier signal from the carrier signal generator 6 by the consonant-clarified signal produced by the speech signal processor 20. The method for amplitude modulation is not limited, and may be, for example, double sideband (DSB) modulation. The output signal thus modulated is amplified by the output amplifier 10, and mechanical vibrations corresponding to the input speech are transmitted to the human body through the vibrator 12.

Thus, in the speech information transmitting device of this embodiment, unlike in the prior art in which the carrier signal is amplitude-modulated by an input speech signal, a consonant-clarified signal is produced in the speech signal processor based on a speech signal and used for amplitude modulation of the carrier signal, making it possible to output information in which the consonants are especially emphasized from the vibrator 12. This improves the discriminability of consonants, which tended to be unclear in the prior art. Especially when the carrier signal has a frequency of 20 to 100 kHz, the discriminability of consonants is further improved since the output signal is transmitted to the human body as ultrasonic vibrations, not as a speech sound.

In order to confirm the effects of the speech information transmitting device of the present invention, a speech sound identification test was carried out as an example.

Figure 5:
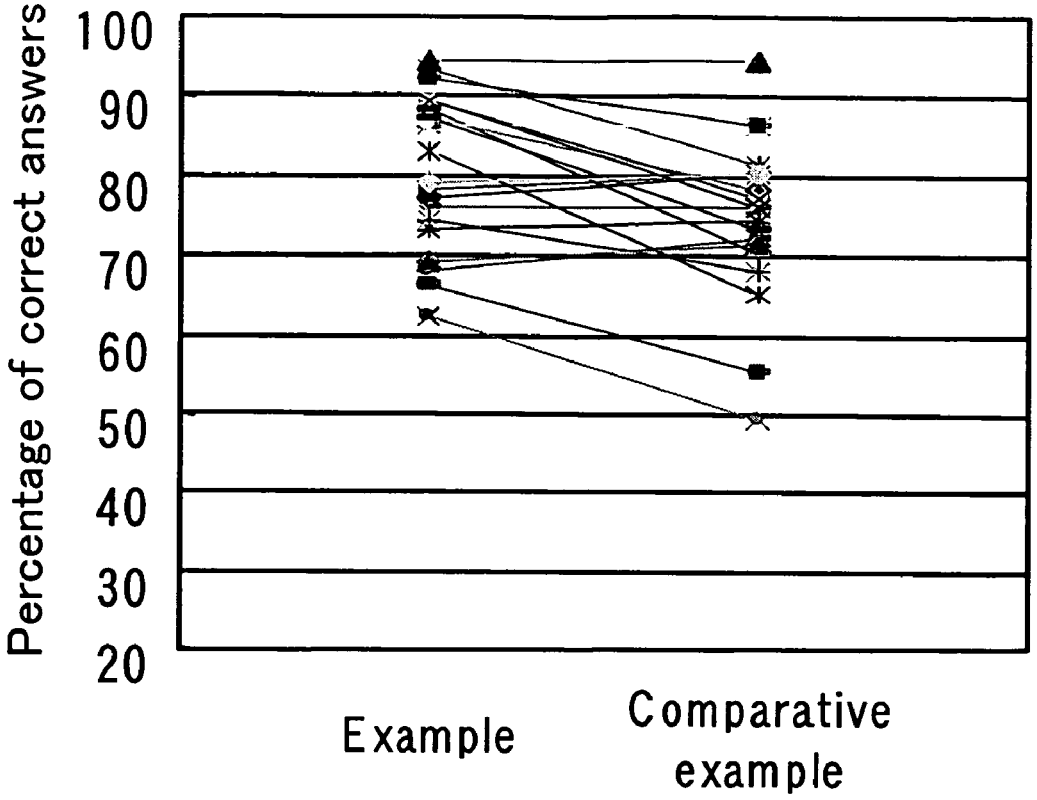
FIG. 5 shows the experimental results of a example and comparative example of the speech information transmitting device according to the first embodiment of the present invention.

In this test, the number of repetitions of each consonant part in the consonant-clarified signal was three including the original consonant part contained in the speech signal as shown in FIG. 4, and the frequency of the carrier signal was 30 kHz. Under such conditions, the discrimination rates of single-digit numerals, such as "ichi (zero)" and "san (three)", were examined in 20 subjects. As a comparative example, the same test was conducted except that the carrier signal was amplitude-modulated by a speech signal without the consonant clarifying processing. FIG. 5 shows the results.

FIG. 5 reveals that, with most of the subjects, the percentage of correct answers is higher in the example than in the comparative example, demonstrating that the present invention improves the discriminability of speech information.

(Second Embodiment)

Figure 6:
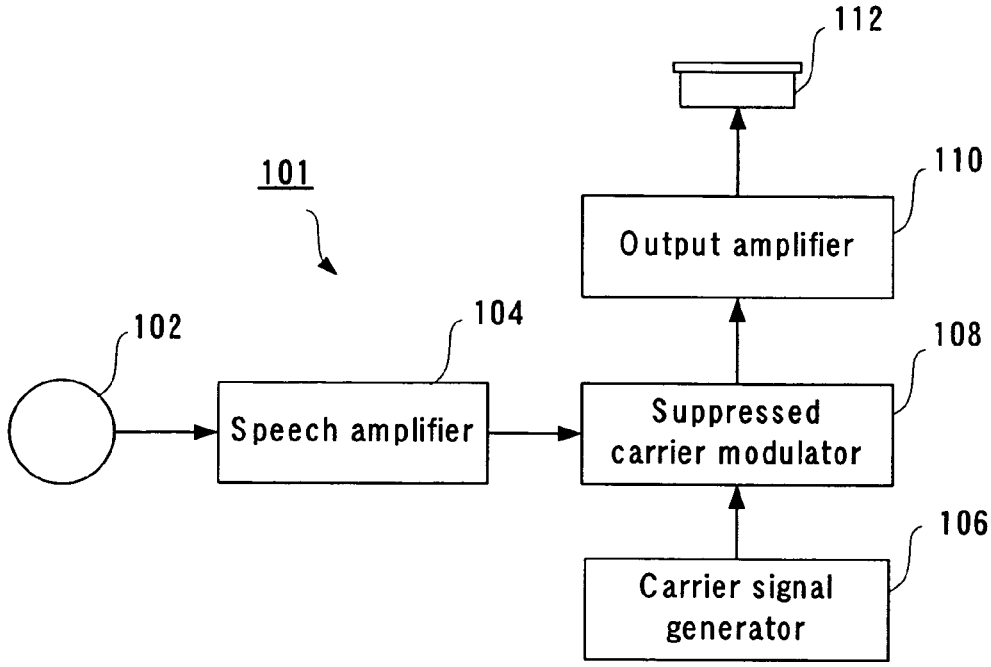
FIG. 6 is a block diagram showing the configuration of a speech information transmitting device according to a second embodiment of the present invention.
Figure 7:
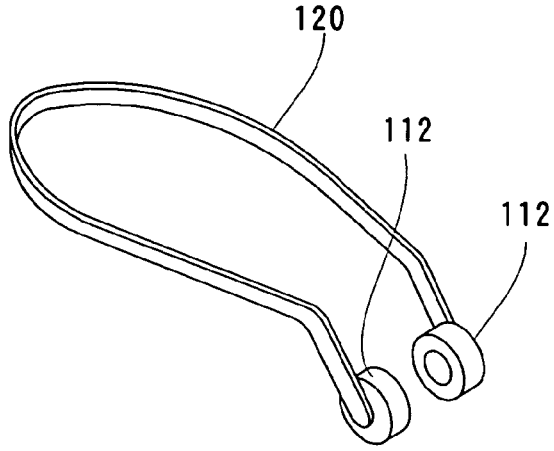
FIG. 7 is a perspective view showing an example of the configuration of the vibration transmitting unit in the speech information transmitting device of FIG. 6.

FIG. 6 is a block diagram showing the configuration of a speech information transmitting device according to a second embodiment of the present invention. As shown in FIG. 6, this speech information transmitting device 101 comprises:

a microphone 102 for inputting speech from an external source;

a speech amplifier 104 that amplifies the input speech signal;

a carrier signal generator 106 that produces a carrier signal;

a suppressed carrier modulator 108 that performs suppressed carrier modulation of the speech signal by the carrier signal;

an output amplifier 110 that amplifies the suppressed carrier signal that is output from the suppressed carrier modulator 108; and a vibrator 112 that transmits mechanical vibrations based on the amplified suppressed carrier signal.

The carrier signal generator 106 produces a desired carrier signal, and has a variable resistor or like means to enable adjustment of the frequency of the carrier signal in the vicinity of the resonance frequency of the vibrator 112. The suppressed carrier modulator 108 modulates the carrier so as to remove the frequency components of the carrier and thereby generates only the double sideband.

The vibrator 112 can be attached, for example, to each end of an elastically deformable, hair band-shaped fitting member 120, which can be worn over the head so that two vibrators 112, 112 can be held in contact with predetermined parts of the human body surface.

Figure 8A:
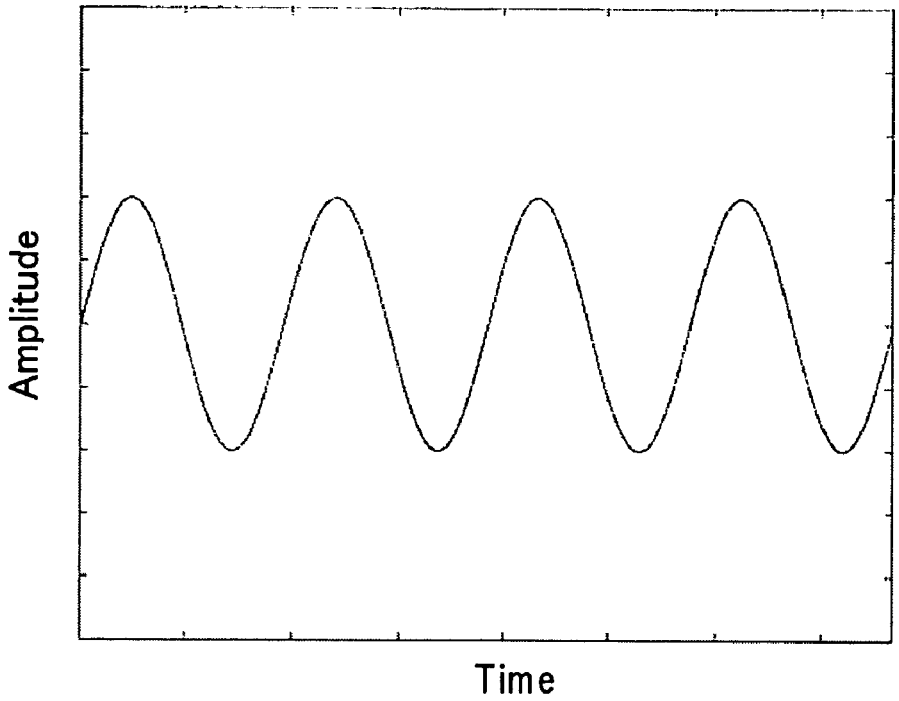
FIG. 8A and FIG. 8B show examples of the waveforms of a speech signal and a suppressed carrier signal, respectively, in the speech information transmitting device of FIG. 6.

Next, the operation of the speech information transmitting device of this embodiment is described. When, with the switch of the device being turned on, speech is input to the microphone 102 from an external source, the speech signal is amplified to a predetermined level by the speech amplifier 104, and then output to the suppressed carrier modulator 108. FIG. 8A shows an example of the speech signal.

In the carrier signal generator 106, a carrier signal consisting of sine waves is produced, like in the prior art. When the device is constructed so that the vibration transmitting unit 130 is to be in contact with the human body as in this embodiment, the frequency of the carrier signal is preferably 20 to 100 kHz, and more preferably 20 to 50 kHz, in order to sufficiently transmit the vibrations to the cerebral auditory areas through the skin, muscles or bone of humans. The carrier signal is output to the suppressed carrier modulator 108.

The suppressed carrier modulator 108 performs suppressed carrier modulation of the speech signal by the carrier to produce a suppressed carrier signal. When the carrier is x2(t) and the speech signal is s2(t), the modulated suppressed carrier signal y2(t) is expressed by the following Equation (1).

$$\begin{aligned} y2(t) &= x2(t)\cdot s2(t) \\ &= \cos w_m t\cdot\cos w_c t \\ &= (\cos w_m t-\cos w_c t)/2+(\cos w_m t+\cos w_c t)/2 \end{aligned} \tag{1}$$

Figure 8B:
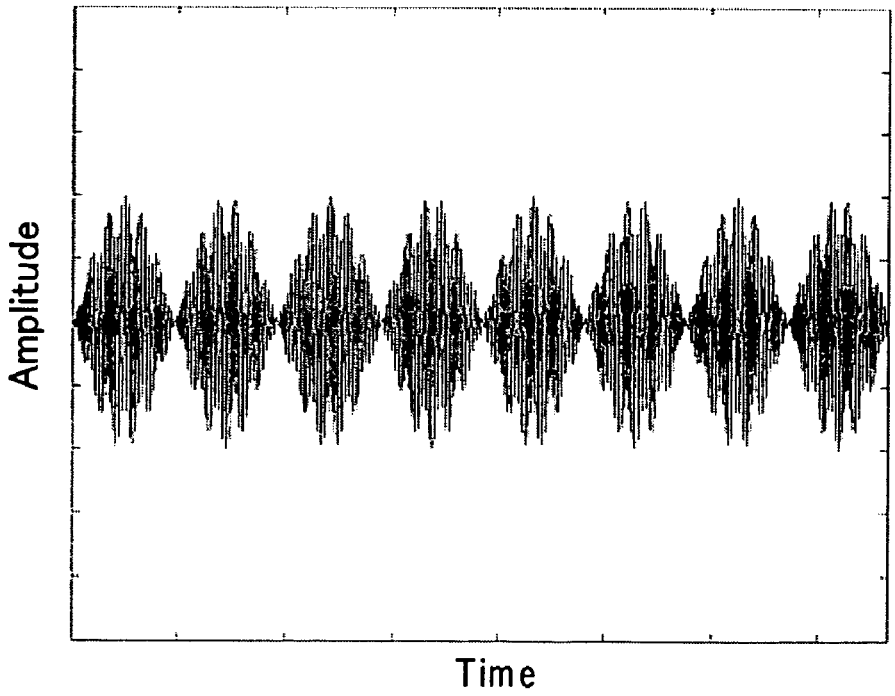
Figure 9:
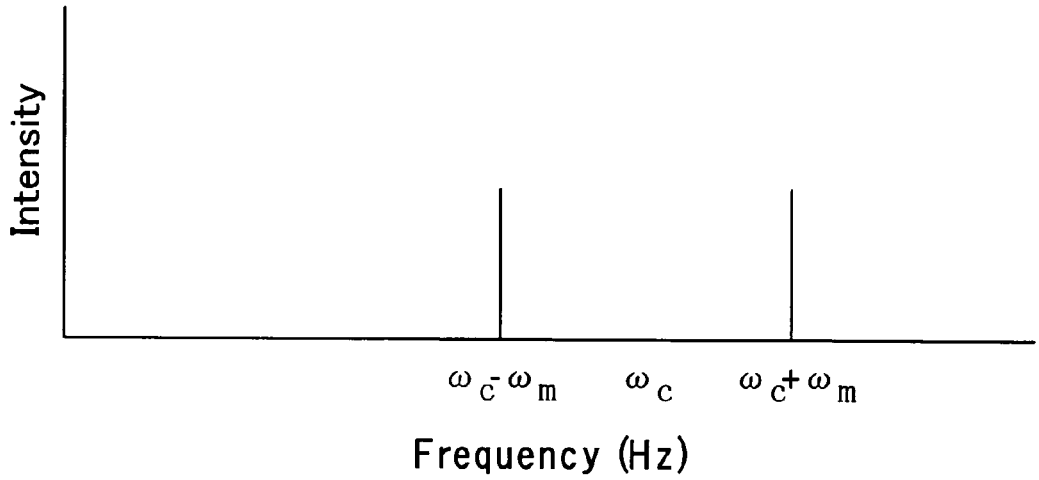
FIG. 9 shows the frequency spectrum of a suppressed carrier signal.

FIG. 8B shows an example of the suppressed carrier signal, and FIG. 9 shows the frequency spectrum thereof. That is, the produced suppressed carrier signal contain no carrier components and consists only of the two sidebands. This suppressed carrier signal is amplified by the output amplifier 110, and mechanical vibrations corresponding to the input speech are transmitted to the human body through the vibrator 112.

Thus, for modulating the speech signal by the carrier in the speech information transmitting device of this embodiment, suppressed carrier modulation is performed so as to remove the carrier and produce only the two sidebands, in place of the normal DSB modulation, which does not suppress the carrier, that is performed in the prior art. As a result, speech information can be accurately transmitted without giving the user an unpleasant feeling caused by the carrier components.

Figure 10:
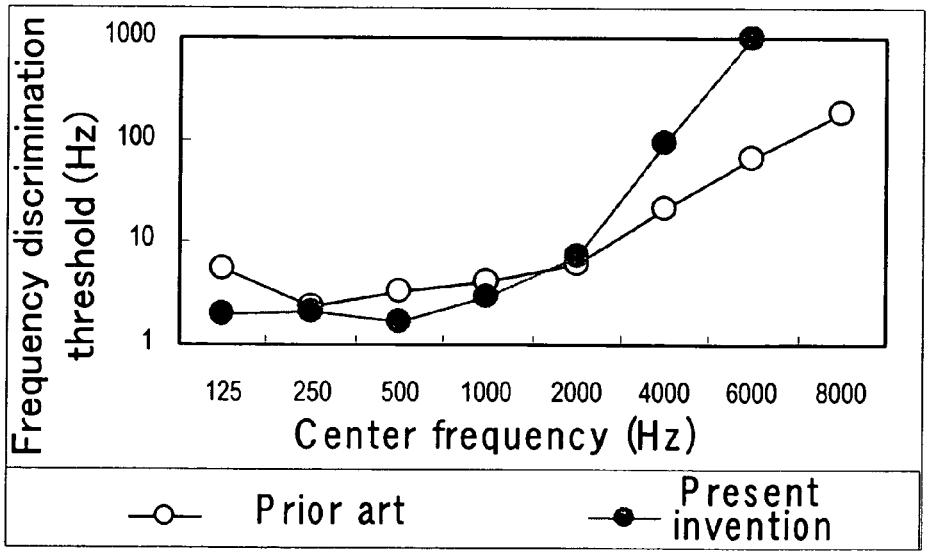
FIG. 10 shows the relation between the frequency of a speech signal (modulating signal), and the frequency discrimination threshold.

Further, the present inventors' experiments proved that suppressed carrier modulation particularly improves the discrimination results of low-frequency (about 125 Hz) components. FIG. 10 is a graph showing the results of measuring the change in the frequency discrimination threshold in relation to the frequency of the speech signal (modulating signal), using the speech information transmitting device of the present invention (suppressed carrier modulation) and a prior art speech information transmitting device (normal DSB modulation). Eight speech signals with center frequencies of 0.125, 0.25, 0.5, 1, 2, 4, 6 and 8 kHz, respectively, and a carrier signal with a frequency of 30 kHz were used. The plotted frequency discrimination thresholds are mean values of four subjects.

FIG. 10 shows that, with the device of the present invention, the frequency discrimination threshold is lower at low frequencies (about 125 Hz) than with the prior art device, whereas it is higher at high frequencies (4 kHz and 8 kHz). Since the frequency discriminability is evaluated as a value relative to the magnitude of the frequency of the speech signal (modulating signal), it is preferable that the frequency discrimination threshold decreases as the frequency of the speech signal decreases. With the speech information transmitting device of the present invention, the change in the frequency discrimination threshold in relation to the frequency of the speech signal (modulating signal) is close to this ideal pattern. Accordingly, high discriminability of speech information can be achieved across a wide frequency range.

Figures 11A, 11B, 11C:
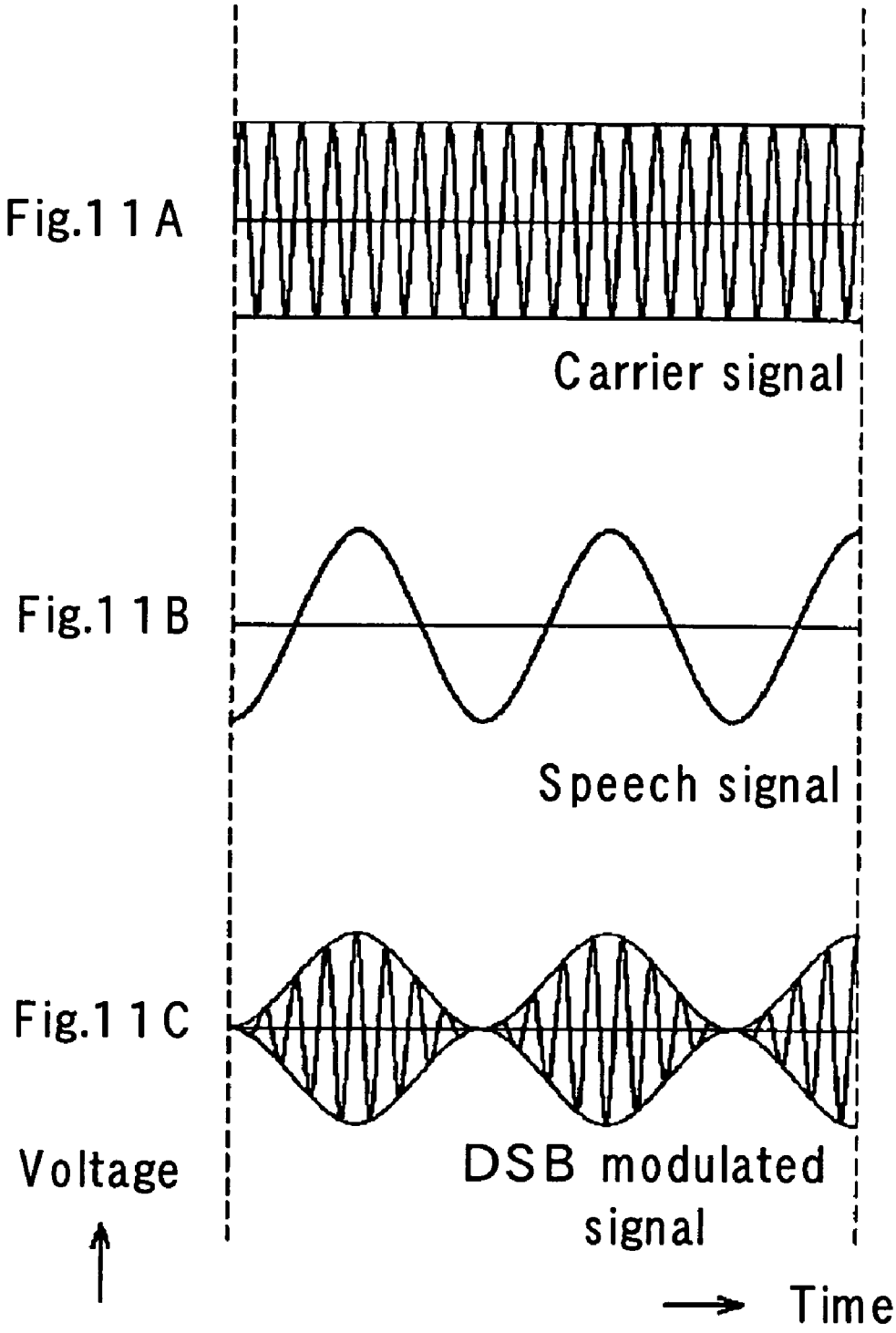
FIG. 11A, FIG. 11B and FIG. 11C show examples of the waveforms of a carrier signal, a speech signal, and a DSB modulated signal, respectively, in a conventional speech information transmitting device.

In contrast, the body conduction hearing device disclosed in Japanese Unexamined Patent Publication No. 2001-320799 amplifies an input speech signal, performs DSB (double sideband) modulation of the amplified speech signal by a carrier signal, and transmits the DSB modulated signal to the human body through an ultrasonic transducer. The publication shows the signals of FIG. 11A, FIG. 11B and FIG. 11C as examples of the carrier signal, speech signal, and DSB modulated signal, respectively, and mentions ultrasonic frequencies around 27 kHz as preferable carrier signal frequencies.

The DSB modulation in this body conduction hearing device is normal amplitude modulation that does not suppress the carrier. Thus, when the carrier signal is x1(t) and the speech signal is s1(t), the modulated signal y1(t) is expressed by the following equation (2) (wherein m is the degree of modulation).

$$\begin{aligned} y1(t) &= x1(t)\cdot s1(t) \\ &= (1+m\cdot\cos w_m t)\cdot\cos w_c t \\ &= \cos w_c t + m\{(\cos w_m t - \cos w_c t)/2 + (\cos w_m t + \cos w_c t)/2\} \end{aligned} \tag{2}$$

Figure 12:
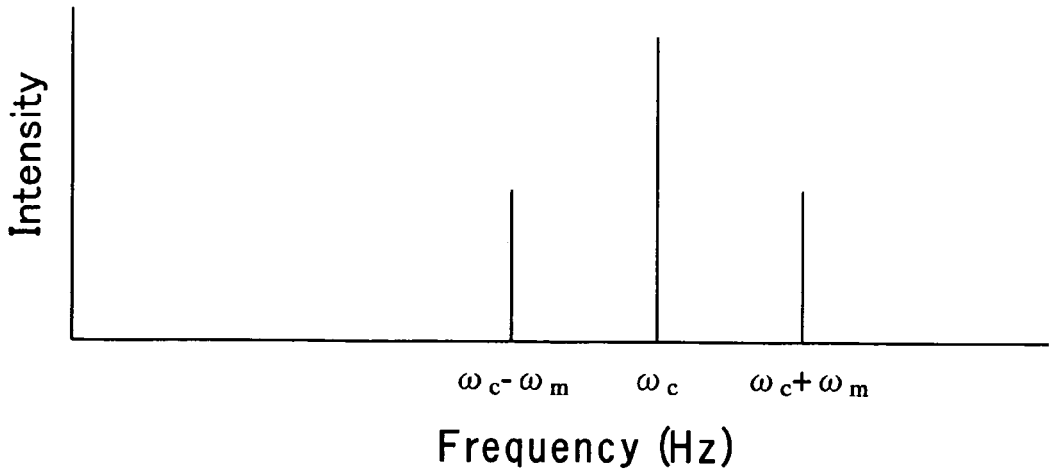
FIG. 12 shows the frequency spectrum of a DSB modulated signal.

FIG. 12 presents the frequency spectrum of the modulated signal, which shows a high spectrum intensity at wc, i.e., the frequency of the carrier.

Since such DSB modulation is performed in the prior art body conduction hearing device, carrier components with a high spectrum intensity are transmitted to the human body and may give the user an unpleasant feeling. Further, with the prior art device, low-frequency components (about 125 Hz) cannot be well distinguished, and there is room for further improvement in discriminability of speech information. Thus, the speech information transmitting device of this embodiment achieved improved speech information discriminability and higher comfort, as compared with the prior art device.

In this embodiment, the carrier signal generator 106 produces a carrier signal consisting of sine waves with constant amplitude and frequency. However, the generator 106 may instead produce a carrier signal consisting of band noise (e.g., in the frequency range of 30±4 kHz), uniform noise (noise that has a flat power spectrum density and whose amplitude probability density function has a square waveform), etc. The use of such noise increases the loudness (subjectively perceived magnitude of sound) as compared with pure sound with the same intensity, and thus relatively decreases the carrier components. As a result, speech information can be transmitted with a better feeling. The band noise and uniform noise preferably have a center frequency of 20 to 100 kHz.

Figure 13:
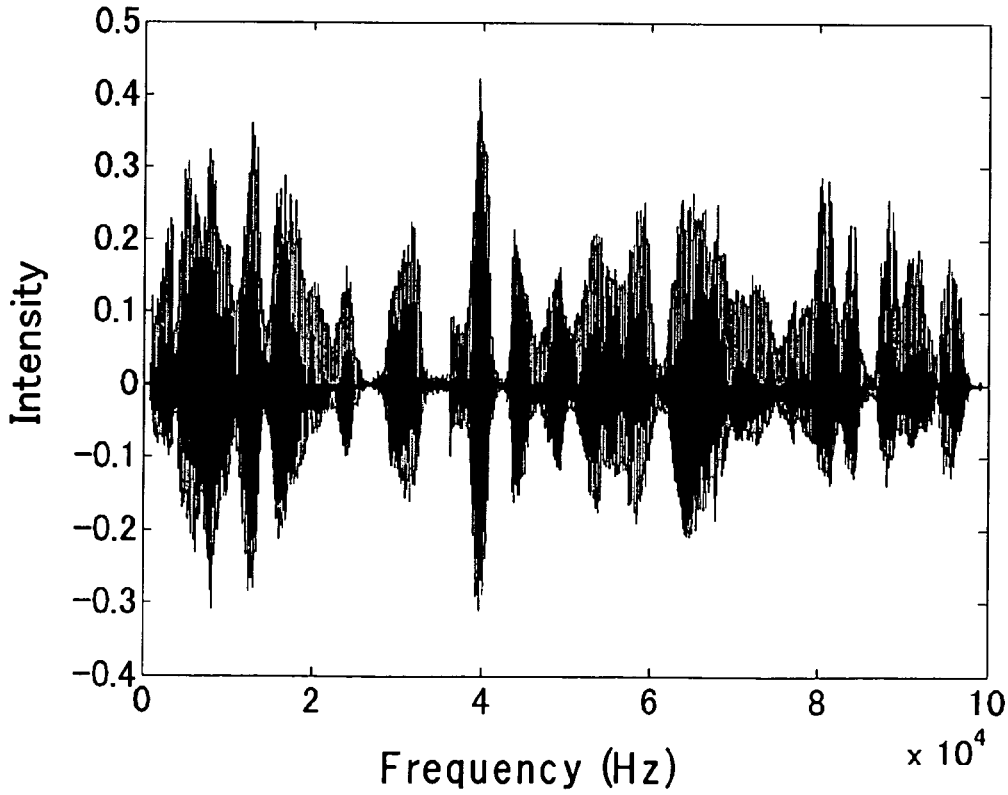
FIG. 13 shows the result of DSB modulation of uniform noise.

Further, the present inventors confirmed by experiments that, even if normal DSB modulation is performed as in the prior art, the use of band noise or uniform noise as a carrier signal improves the comfort when transmitting speech information. FIG. 13 shows one of the results of the normal DSB modulation of uniform noise.

(Third Embodiment)

Figure 14:
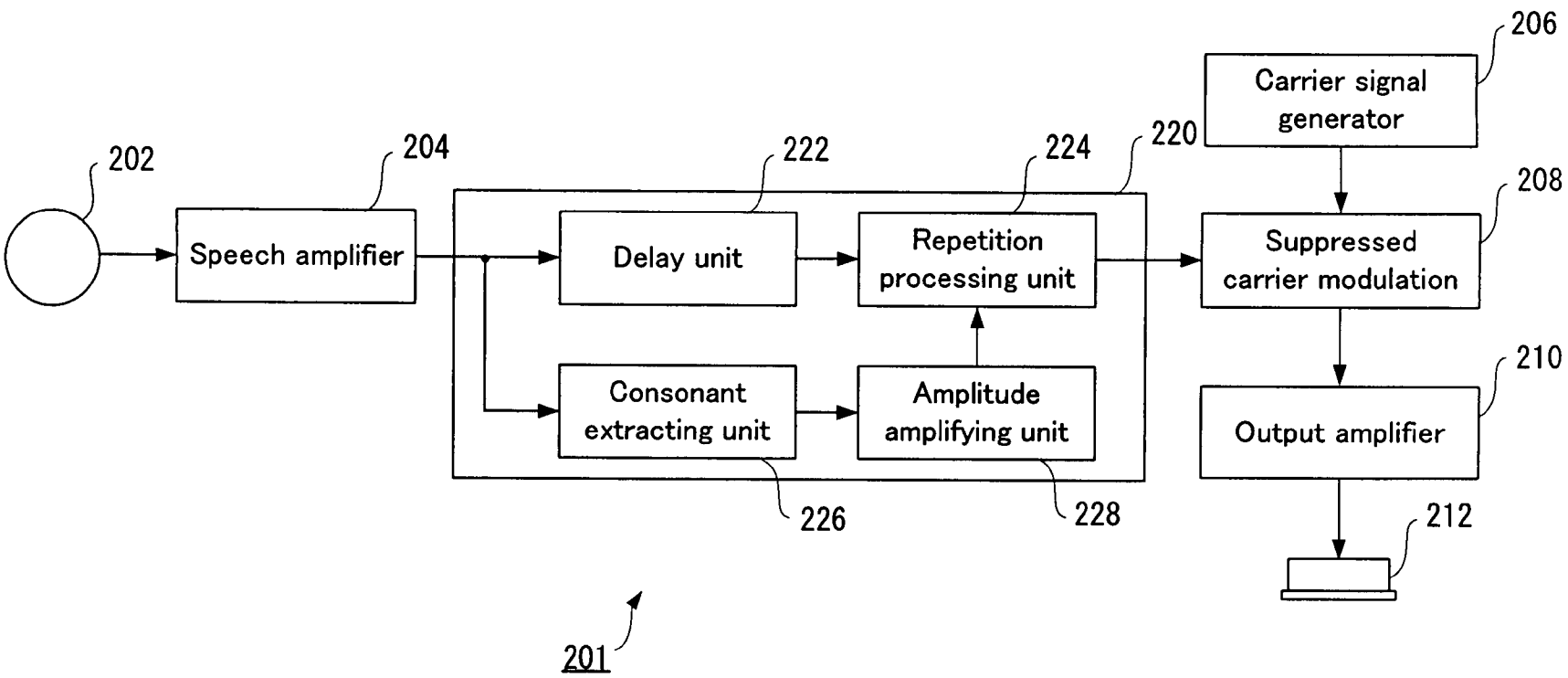
FIG. 14 is a block diagram showing the configuration of the speech information transmitting device according to a third embodiment of the present invention.

FIG. 14 is a block diagram showing the configuration of a speech information transmitting device according to a third embodiment of the present invention. As shown in FIG. 14, this speech information transmitting device 201 comprises:

a microphone 202 for inputting speech from an external source;

a speech amplifier 204 that amplifies the input speech signal;

a speech signal processor 220 that produces a consonant-clarified signal based on the speech signal;

a carrier signal generator 206 that produces a carrier signal;

a suppressed carrier modulator 208 that performs suppressed carrier modulation of the consonant-clarified signal that is output from the speech signal processor 220 by the carrier signal;

an output amplifier 210 that amplifies the suppressed carrier signal that is output from the suppressed carrier modulator 208; and a vibrator 212 that transmits mechanical vibrations based on the amplified suppressed carrier signal;

the speech signal processor 220 comprising a delay unit 222, a repetition processing unit 224, a consonant extracting unit 226, and an amplitude amplifying unit 228.

The configurations of the microphone 202, speech amplifier 204, and speech signal processor 220, including modifications thereof, are similar to those of the microphone 2, speech amplifier 4, and speech signal processor 20, respectively, of the first embodiment (FIG. 1), and the configurations of the carrier signal generator 206, suppressed carrier modulator 208, output amplifier 210, and vibrator 212, including modifications thereof, are similar to those of the carrier signal generator 106, suppressed carrier modulator 108, output amplifier 110, and vibrator 112, respectively, of the second embodiment (FIG. 6). Thus, detailed descriptions thereof are omitted.

In the speech information transmitting device of this embodiment, when, with the switch of the device being turned on, speech is input to the microphone 202 from an external source, the speech signal is amplified to a predetermined level by the speech amplifier 204 and then output to the speech signal processor 220.

In the speech signal processor 220, the consonant-clarified signal (e.g., FIG. 4) is produced, as described in the first embodiment. The consonant-clarified signal is output to the suppressed carrier modulator 208.

The carrier signal generator 206 produces a carrier signal, which is output to the suppressed carrier modulator 208. The suppressed carrier modulator 208 performs suppressed carrier modulation of the consonant-clarified signal by the carrier to produce a suppressed carrier signal. This suppressed carrier signal is amplified by the output amplifier 210, and mechanical vibrations are transmitted to the human body through the vibrator 212.

Thus, in the speech information transmitting device of this embodiment, the consonant-clarified signal in which the consonants are especially emphasized is subjected to suppressed carrier modulation, to thereby improve the discriminability of consonants, which tend to be unclear, and prevent giving the user an unpleasant feeling caused by carrier components. This enables accurate transmission of speech information.

The invention claimed is:

1. A device for transmitting speech information to the human body, comprising:

a microphone for inputting speech from an external source;

a speech signal processor that produces a consonant-clarified signal based on the input speech signal;

a carrier signal generator that produces a carrier signal;

an amplitude modulator that modulates the amplitude of the carrier signal based on the consonant-clarified signal; and a vibrator that transmits mechanical vibrations based on the amplitude-modulated output signal;

the speech signal processor comprising:

a consonant extracting unit that extracts consonant parts from the speech signal; and a repetition processing unit that adds the extracted consonant parts to the speech signal to produce the consonant-clarified signal in which each of the consonant parts of the speech signal is repeated two or more times.

2. The device according to claim 1, wherein the consonant extracting unit extracts consonant parts based on the detection, in the speech signal, of an interval with an amplitude equal to or smaller than a predetermined value.

3. The device according to claim 1, wherein:

the speech signal processor further comprises an amplitude amplifying unit that amplifies the amplitude of the extracted consonant parts; and the repetition processing unit that produces the consonant-clarified signal in which each of the amplified consonant parts is repeated two or more times.

4. The device according to claim 3, wherein, in the amplitude amplifying unit, the amplitude ratio of the output signal relative to the input signal is 1 to 5.

5. The device according to claim 1, wherein the carrier signal has a frequency of 20 to 100 kHz.

6. The device according to claim 1, wherein:

the speech signal processor further comprises a delay unit that delays the input speech signal; and the repetition processing unit that adds the extracted consonant parts to the speech signal delayed by the delay unit.

7. The device according to claim 1, wherein the number of repetitions of each of the consonant parts in the consonant-clarified signal is 2 to 5.

8. A device for transmitting speech information to the human body, comprising:

a microphone for inputting speech from an external source;

a speech amplifier that amplifies the input speech signal;

a carrier signal generator that produces a carrier signal;

a suppressed carrier modulator that performs suppressed carrier modulation of the speech signal by the carrier signal, to produce a suppressed carrier signal from which the carrier components have been removed;

an output amplifier that amplifies the suppressed carrier signal; and a vibrator that transmits mechanical vibrations based on the amplified suppressed carrier signal;

wherein the carrier signal consists of band noise or uniform noise with a center frequency of 20 to 100kHz.

9. A device for transmitting speech information to the human body, comprising:

a microphone for inputting speech from an external source;

a speech signal processor that produces a consonant-clarified signal based on the input speech signal;

a carrier signal generator that produces a carrier signal;

a suppressed carrier modulator that performs suppressed carrier modulation of the consonant-clarified signal by the carrier signal, to produce a suppressed carrier signal from which the carrier components have been removed;

an output amplifier that amplifies the suppressed carrier signal; and a vibrator that transmits mechanical vibrations based on the amplified suppressed carrier signal;

the speech signal processor comprising:

a consonant extracting unit that extracts consonant parts from the speech signal; and a repetition processing unit that adds the extracted consonant parts to the speech signal to produce the consonant-clarified signal in which the consonant parts of the speech signals are repeated two or more times.

10. The device according to claim 9, wherein the carrier signal has a frequency of 20 to 100 kHz.

* * * * *

UNITED STATES PATENT AND TRADEMARK OFFICE

CERTIFICATE OF CORRECTION

PATENT NO. : 7,457,741 B2
APPLICATION NO. : 11/091480
DATED : November 25, 2008
INVENTOR(S) : Seiji Nakagawa et al.

It is certified that error appears in the above-identified patent and that said Letters Patent is hereby corrected as shown below:

On the Title page:

Item "(73)" Assignee: should read as: --NATIONAL INSTITUTE OF ADVANCED INDUSTRIAL SCIENCE AND TECHNOLOGY, TOKYO, JAPAN--.

Signed and Sealed this

Twenty-seventh Day of January, 2009

John Doll

JOHN DOLL
*Acting Director of the United States Patent and Trademark Office*